US007999648B2

(12) United States Patent
Nakatani et al.

(10) Patent No.: US 7,999,648 B2
(45) Date of Patent: Aug. 16, 2011

(54) WIRE-WOUND COIL AND METHOD FOR MANUFACTURING WIRE-WOUND COIL

(75) Inventors: Keigo Nakatani, Shiga-ken (JP); Yoshie Nishikawa, Tsim Sha Tsui (HK)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/711,837

(22) Filed: Feb. 24, 2010

(65) Prior Publication Data

US 2010/0148912 A1 Jun. 17, 2010

Related U.S. Application Data

(63) Continuation of application No. PCT/JP2008/064976, filed on Aug. 22, 2008.

(30) Foreign Application Priority Data

Aug. 31, 2007 (JP) ..... 2007-226689

(51) Int. Cl.
*H01F 27/28* (2006.01)

(52) U.S. Cl. ..... 336/182; 336/83; 336/183; 336/208; 336/221

(58) Field of Classification Search ..... 336/83, 336/182, 183, 208, 221
See application file for complete search history.

(56) References Cited

U.S. PATENT DOCUMENTS

| | | | | |
|---|---|---|---|---|
| 2,296,915 | A * | 9/1942 | Foster | 334/78 |
| 3,042,999 | A * | 7/1962 | Page et al. | 29/603.13 |
| 5,508,673 | A * | 4/1996 | Staszewski | 336/184 |
| 6,094,109 | A * | 7/2000 | Greene et al. | 333/181 |
| 6,344,787 | B1 * | 2/2002 | McGrane et al. | 336/198 |
| 6,778,055 | B1 * | 8/2004 | Wang | 336/83 |
| 7,215,232 | B2 * | 5/2007 | Aoki et al. | 336/83 |
| 7,373,715 | B2 * | 5/2008 | Hirai et al. | 29/606 |
| 7,495,538 | B2 * | 2/2009 | Tsunemi et al. | 336/84 M |

FOREIGN PATENT DOCUMENTS

JP 2004-146671 A 5/2004

* cited by examiner

*Primary Examiner* — Anh T Mai
*Assistant Examiner* — Joselito Baisa
(74) *Attorney, Agent, or Firm* — Studebaker & Brackett PC; Tim L. Brackett, Jr.

(57) ABSTRACT

A wire-wound coil has a characteristic impedance that can be flexibly adjusted and can be prevented from varying undesirably. In the coil of the present invention, a primary wire part 18A and a secondary wire part 18B are wound around the surface of a core portion 14 so as to be separated from each other by a fixed distance. At the same time, at least one portion the secondary wire part 18B in a prior turn section 19X and at least one portion of the primary wire part 18A in a subsequent turn section 19Y are in close contact with each other, wherein the wire parts 18A and 18B are wound in different turns and are adjacent to each other on the same surface of the core portion 14. A method for manufacturing the wire-wound coil is also disclosed.

3 Claims, 3 Drawing Sheets

WIRE-WOUND COIL AND METHOD FOR MANUFACTURING WIRE-WOUND COIL

CROSS REFERENCE TO RELATED APPLICATIONS

The present application is a continuation of International Application No. PCT/JP2008/064976, filed Aug. 22, 2008, which claims priority to Japanese Patent Application No. 2007-226689 filed Aug. 31, 2007, the entire contents of each of these applications being incorporated herein by reference in their entirety.

BACKGROUND OF THE INVENTION

1. Field of the Invention

The present invention relates to wire-wound coils including pairs of wound windings and methods for manufacturing wire-wound coils.

2. Description of the Related Art

A known wire-wound coil includes a core member including a columnar core portion and a pair of collar portions formed at either end of the core portion, a pair of wires including a primary coil and a secondary coil wound around the surface of the core portion, and electrode portions, to which the ends of the coils are electrically connected, formed on the pair of collar portions. The primary coil and the secondary coil in the same winding turn are wound around the surface of the core portion so as to be separated from each other (See Japanese Unexamined Patent Application Publication No. 2004-146671).

Since the above-described wire-wound coil has the wires wound around the planar surface of the core portion and does not have any means for positioning the wires, the wires move over the surface of the core portion in some cases. Further, when the wires move over the surface of the core portion, the characteristic impedance of the coil in correlation with the distance between the wires cannot be flexibly adjusted.

Moreover, since the separation of a pair of adjacent wires causes variations in the electrostatic capacitance between the wires, the characteristic impedance of the coil may vary widely depending on variations in the winding of the wires.

SUMMARY OF THE INVENTION

The present invention has been developed in view of the above-described problems, and it is an object of the present invention is to provide a wire-wound coil whose characteristic impedance can be flexibly adjusted and can be prevented from varying and a method for manufacturing a wire-wound coil.

A first embodiment of the present invention for solving the above-described problems is directed to a wire-wound coil including a core member including a core portion and collar portions formed at either end of the core portion, a pair of windings including a primary winding part and a secondary winding part wound around the surface of the core portion, and electrode portions formed on the collar portions, the ends of the primary winding part and the ends of the secondary winding part of the windings being connected to the electrode portions. At least one portion of the primary winding part and at least one portion of the secondary winding part of the pair of windings wound around the core portion are separated from each other. At the same time, at least another portion of the secondary winding part in a prior turn section is in contact with at least another portion of the primary winding part in a subsequent turn section, and thus those portions of the primary and secondary winding parts are wound in different turns and are adjacent to each other on the same surface of the core portion.

A second embodiment of the present invention is directed to a method for manufacturing a wire-wound coil including a core member including a core portion and collar portions formed at either end of the core portion, a pair of windings including a primary winding part and a secondary winding part wound around the surface of the core portion, and electrode portions formed on the collar portions, wherein the ends of the primary winding part and the ends of the secondary winding part of the windings being connected to the electrode portions. The pair of windings on the surface of the core portion is formed such that at least one portion of the primary winding part and at least one portion of the secondary winding part are separated from each other and such that at least another portion of the primary winding part in a subsequent turn section and at least another portion of the secondary winding part in a prior turn section is in contact with each other, wherein these portions of the primary and secondary windings are wound in different turns and are adjacent to each other on the same surface of the core portion.

The method of the second embodiment may be further characterized in that the primary winding part and the secondary winding part include the prior turn section wound around the surface of the core portion first and then the subsequent turn section wound around the surface of the core portion subsequent to the prior turn section, and that the at least another portion of the primary winding part in the subsequent turn section and the at least another portion of the secondary winding part in the prior turn section are in contact with each other such that a distance in a winding-axis direction between the center of the at least another portion of the secondary winding part in the prior turn section and the center of the at least another portion of the primary winding part in the subsequent turn section corresponds to the radius of the primary winding part or the radius of the secondary winding part.

According to the first embodiment, one portion of one of the primary winding part and the secondary winding part, whose winding turn section is different from that of the other winding part, is positioned with reference to the other portion of the other of the primary winding part and the secondary winding part, and the one portion or the other portion of the primary winding part and the secondary winding part can be prevented from moving over the surface of the core portion.

In the above-described manner, the electrostatic capacitance can be freely adjusted by setting the interval between the primary winding part and the secondary winding part of the pair of windings on the surface of the core portion. Moreover, the contact between the one portion of the primary winding part and the secondary winding part and the other portion of the primary winding part and the secondary winding part, which are wound in different turns, can prevent variations in the electrostatic capacitance existing between portions wound in different turns, and as a result, can prevent variations in the characteristic impedance of the wire-wound coil.

According the second embodiment, the one portion of one of the primary winding part and the secondary winding part, whose winding turn is different from that of the other portion of the winding part, is positioned with reference to the other portion of the other of the primary winding part and the secondary winding part, and hence can be prevented from moving over the surface of the core portion.

In manner described above, the electrostatic capacitance can be freely adjusted by setting the interval between the primary winding part and the secondary winding part of the pair of windings on the surface of the core portion.

Moreover, the contact between the one of the primary winding part and the secondary winding part and the other of the primary winding part and the secondary winding part, the one part and the other part being wound in different turns, can prevent variations in the electrostatic capacitance existing between portions wound in different turns, and as a result, can prevent variations in the characteristic impedance of the wire-wound coil.

With respect to the second embodiment, the one portion of one of the primary winding part and the secondary winding part in the subsequent turn section is positioned at an appropriate position on the surface of the core portion while being in close contact with another portion of the other of the primary winding part and the secondary winding part in the prior turn section. As a result, irregular winding can be prevented, and the windings can be stably wound.

DESCRIPTION OF THE PREFERRED EMBODIMENTS

Embodiments of the present invention directed to a wire-wound coil and a method for manufacturing thereof will be described with reference to the accompanying drawings.

Figure 1:
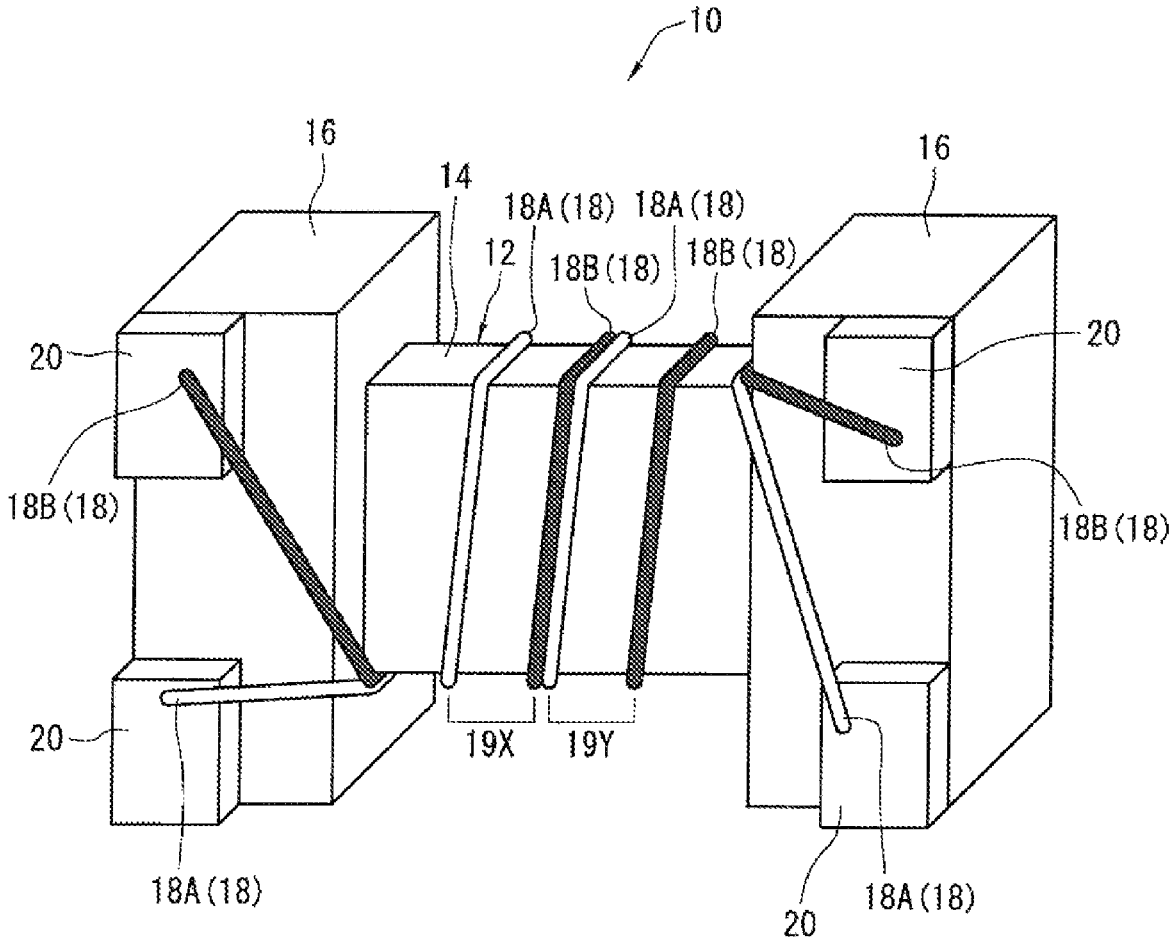
FIG. 1 is a perspective view illustrating the structure of a wire-wound coil according to an embodiment of the present invention.
Figure 2:
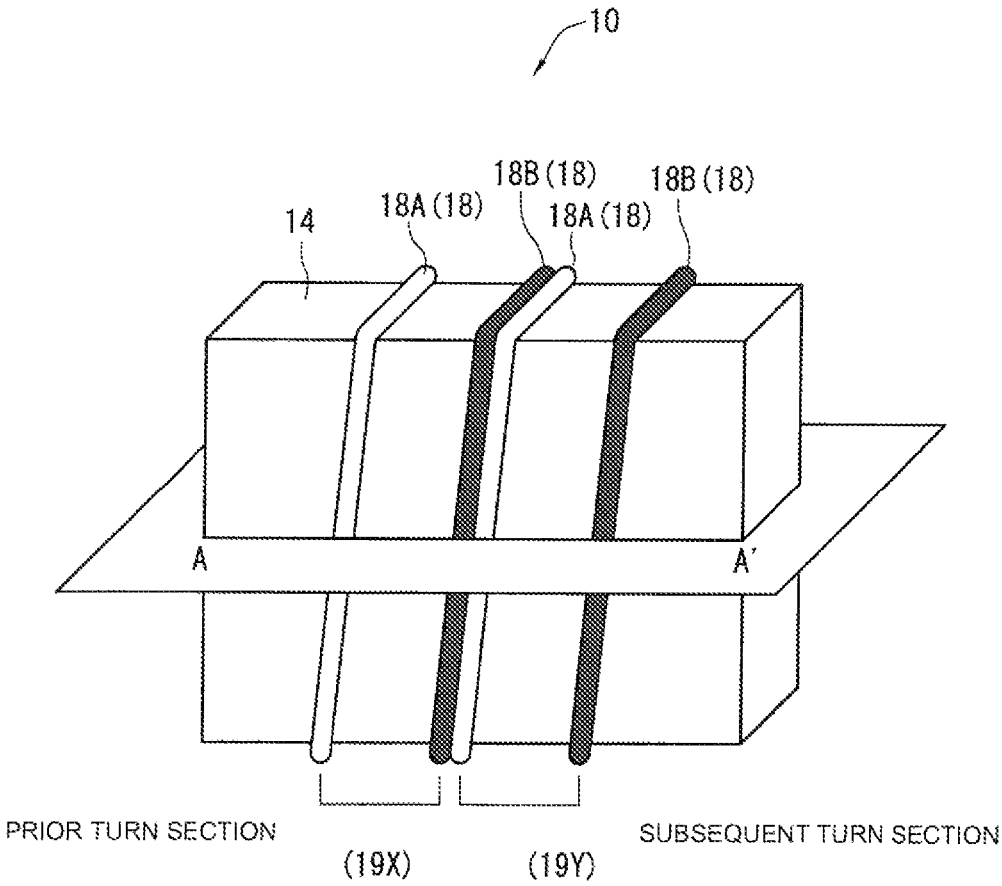
FIG. 2 is a perspective view illustrating a winding state of windings wound around a core portion of the wire-wound coil according to the embodiment of the present invention.

As shown in FIGS. 1 and 2, a wire-wound coil 10 includes a core member 12 including a core portion 14 and collar portions 16 formed at either end of the core portion 14. The core member 12 is formed by sintering a magnetic or non-magnetic body. The surface of the core portion 14 is made smooth (i.e., planar) so as not to have any protrusions, and a pair of wires (i.e., windings) 18 are wound around the surface. These wires 18 include a primary wire part (i.e., primary winding part) 18A and a secondary wire part (i.e., secondary winding part) 18B.

Moreover, electrode portions 20 are formed on sidewalls of the collar portions 16. The ends of the primary wire part 18A and those of the secondary wire part 18B of the wires 18 are connected to the respective electrode portions 20 by, for example, heat bonding.

Each of the electrode portions 20 includes a film layer of 10 to 30 μm composed of, for example, Ag, Ag—Pd, or Ag—Pt and a plated layer of 1 to 30 μm composed of, for example, Ni, Sn, or Sn—Pd formed on the film layer.

The electrode portions 20 can be formed by, for example, printing or dipping using masks or the like, or by transferring patterns formed on a rubber plate.

The wires 18 are covered with insulating coatings, and are composed of, for example, Cu, Ag, or Au. The wires 18 are wound around the surface of the core portion 14 such that at least one portion of the primary wire part 18A and at least one portion of the secondary wire part 18B are separated from each other.

However, at least one other portion of the primary wire part 18A and at least one other portion of the secondary wire part 18B are in contact (or close contact) with each other between winding turns. The primary wire part and the secondary wire part are wound in different turns and are adjacent to each other on the same surface of the core portion 14. In particular, the secondary wire part 18B in a prior turn section 19X, and the primary wire part 18A in a subsequent turn section 19Y (i.e., between the winding turns) are brought into close contact with each other.

Figure 3:
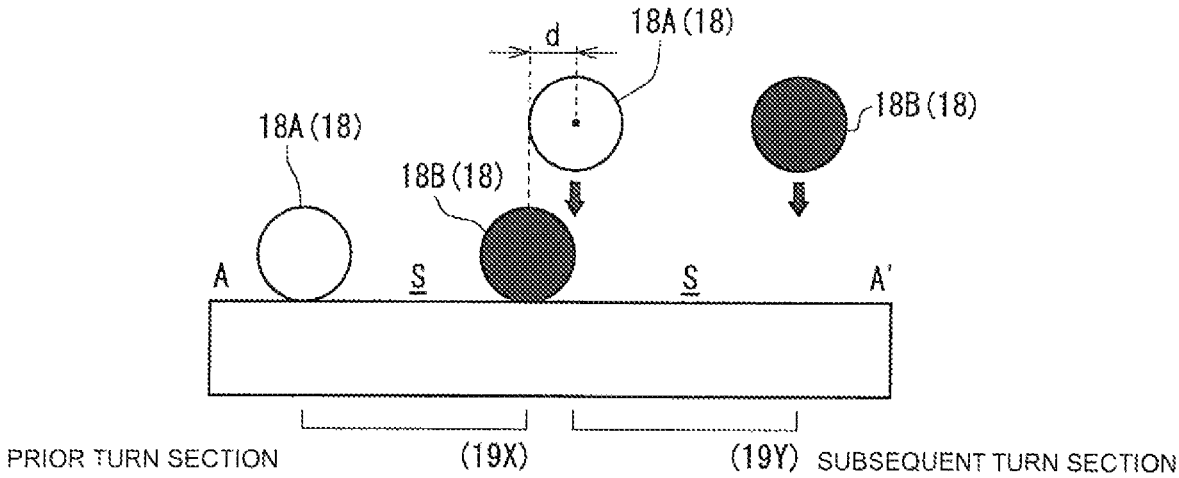
FIG. 3 illustrates a section A-A' shown in FIG. 2 when the windings of the wire-wound coil according to the embodiment of the present invention are wound around the core portion.

Further, as shown in FIG. 3, one portion of one of the primary wire part 18A and the secondary wire part 18B in the subsequent turn section 19Y, the one wire part to be brought into contact with the other portion of the other of the primary wire part 18A and the secondary wire part 18B in the prior turn section 19X wound around the surface of the core portion 14, is wound on the other portion of the other of the primary wire part 18A and the secondary wire part 18B in the prior turn section 19X wound around the surface of the core portion 14 such that the distance d in a winding-axis direction between the center portion of the other portion of the other of the primary wire part 18A and the secondary wire part 18B in the prior turn section 19X, and the center of the one of the primary wire part 18A and the secondary wire part 18B in the subsequent turn section 19Y corresponds to the radius of the primary wire part 18A or that of the secondary wire part 18B. In particular, the a diameter of the primary wire part 18A and a diameter of the secondary wire part 18B are substantially the same, and the distance d between the center of the secondary wire part 18B in the prior turn section 19X and that of the primary wire part 18A in the subsequent turn section 19Y corresponds to the radius (half the diameter).

Next, a method for manufacturing the wire-wound coil 10 according to an embodiment of the present invention will be described.

As shown in FIGS. 1 and 2, one of the collar portions 16 having the electrode portions 20 formed thereon is fixed to a chuck (not shown), one end of the primary wire part 18A and one end of the secondary wire part 18B of the wires 18 extracted from nozzles for windings (not shown) are positioned on the electrode portions 20 on the other collar portion 16. The core member 12 is then rotated while the ends of the wire parts are positioned on the electrode portions so that the wires are wound around the core portion 14, as in, e.g., a spindle winding. After the wires 18 are wound around the core portion 14, the other end of the primary wire part 18A and the other end of the secondary wire part 18B of the wires 18 are disposed on the electrode portions 20 on the one collar portion 16.

The wires 18 are wound around the core portion 14 such that the primary wire part 18A and the secondary wire part 18B of the wires 18 are separated from each other by a desired distance on the surface of the core portion 14. With this, a gap S is left between a pair of the primary wire part 18A and the secondary wire part 18B of the wires 18, which are adjacent to each other, as shown in FIG. 3. At this time, the primary wire part 18A in the subsequent turn section 19Y is brought into contact with the secondary wire part 18B in the prior turn section 19X and is wound on the secondary wire part 18B in the prior turn section 19X such that there is the distance d in the winding-axis direction between the center of the secondary wire part 18B in the prior turn section 19X and the center of the primary wire part 18A in the subsequent turn section 19Y corresponds to the radius of the primary wire part 18A (the secondary wire part 18B).

After the wires 18 are wound around the core portion 14, both ends of the primary wire part 18A and those of the secondary wire part 18B of the wires 18 are connected to the respective electrode portions 20. Examples of the connection method include heat bonding. With this, both ends of the primary wire part 18A and those of the secondary wire part 18B of the wires 18 are compressed and brazed to Sn in the outermost layers of the electrodes, resulting in highly reliable joining.

Since the secondary wire part 18B in the prior turn section 19X and the primary wire part 18A in the subsequent turn section 19Y are positioned while being wound so as to be in close contact with each other on the same surface of the core portion 14 in this manner, irregular winding of the wires 18 can be prevented. This leads to a wire-wound coil 20 with fewer variations in the characteristic impedance.

Next, effects of the wire-wound coil 10 according to an embodiment of the present invention will be described.

As shown in FIGS. 1 and 2, at least one portion of the primary wire part 18A and at least one portion of the secondary wire part 18B are wound around the surface of the core portion 14 so as to be separated from each other by a fixed distance. At the same time, another portion of the secondary wire part 18B in the prior turn section 19X and another portion of the primary wire part 18A in the subsequent winding section 19Y are in close contact with each other, wherein the wire parts 18A and 18B are wound in different turns and being adjacent to each other on the same surface of the core portion 14. This can prevent the secondary wire part 18B in the prior turn section 19X or the primary wire part 18A in the subsequent turn section 19Y from being displaced on the surface of the core portion 14 in the axis direction. As a result, the distance between the primary wire part 18A and the secondary wire part 18B that constitute each winding turn can always be fixed. Thus, variations in the electrostatic capacitance existing between two adjacent winding turns can be prevented, and variations in the characteristic impedance of the wire-wound coil 10 can also be prevented.

Figure 4:
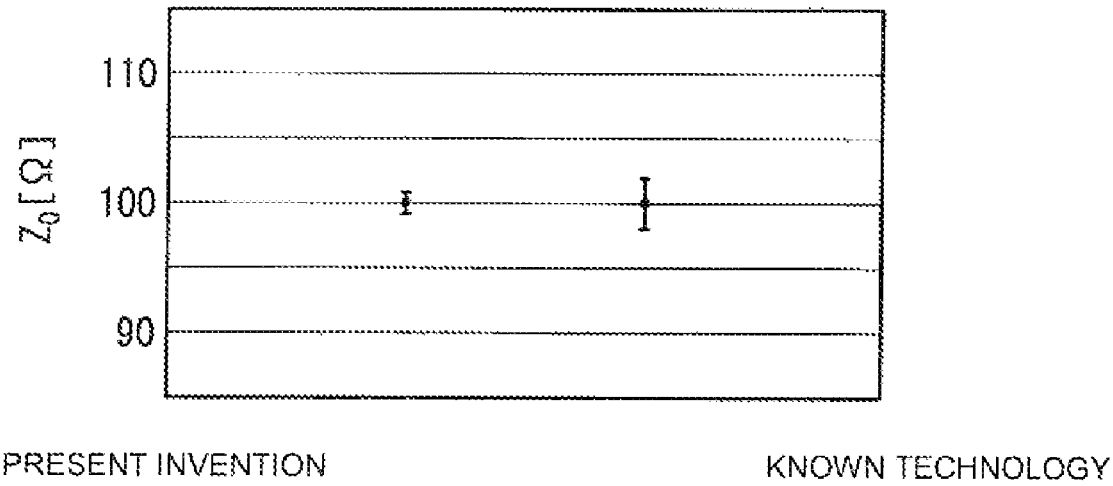
FIG. 4 illustrates variations in the characteristic impedance of the wire-wound coil according to the embodiment of the present invention, in which two adjacent winding turns are in close contact, and those of a known wire-wound coil, in which two adjacent winding turns are not in close contact.

FIG. 4 illustrates a comparison between the wire-wound coil according to this embodiment (e.g., diameter of 40 μm, two adjacent winding turns are in close contact) and a wire-wound coil according to a known technology (e.g., diameter of 40 μm, two adjacent winding turns are not in close contact). As is clear from FIG. 4, variations in the characteristic impedance of the wire-wound coil according to this embodiment are markedly reduced compared with those of the wire-wound coil according to the known technology.

Moreover, as shown in FIG. 3, the primary wire part 18A in the subsequent turn section 19Y, the wire part 18A to be brought into contact with the secondary wire part 18B in the prior turn section 19X wound around the surface of the core portion 14, is wound on the secondary wire part 18B in the prior turn section 19X wound around the surface of the core portion 14 such that the distance d in the winding-axis direction between the center of the secondary wire part 18B in the prior turn section 19X and the center of the primary wire part 18A in the subsequent turn section 19Y corresponds to the radius of the primary wire part 18A (the secondary wire part 18B). Accordingly, the primary wire part 18A in the subsequent turn section 19Y is positioned on the surface of the core portion 14 at an appropriate position while being in close contact with the secondary wire part 18B in the prior turn section 19X. As a result, irregular winding can be prevented, and the wires 18 can be stably wound.

Furthermore, the electrostatic capacitances between two adjacent winding turns can be easily changed by adjusting the interval between the primary wire part 18A and the secondary wire part 18B wound around the surface of the core portion 14.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A wire-wound coil comprising:

a core member including a core portion and collar portions formed at either end of the core portion; the core portion including a prior turn section and an adjacent subsequent turn section;

the prior turn section has a first position and a second position, the first and second positions being at a predetermined distance apart from each other;

the subsequent turn section has a first position and a second position, the first and second positions being at a predetermined distance apart from each other;

the second position of the prior turn section being adjacent to the first position of the subsequent turn section;

a pair of windings including a primary winding part and a secondary winding part wound around a surface of the core portion; and electrode portions formed on the collar portions, wherein ends of the primary winding part and ends of the secondary winding part of the windings are connected to the electrode portions, wherein at least one portion of the primary winding part positioned at the first position in the prior turn section and at least one portion of the secondary winding part positioned at the second position in the prior turn section are separated from each other by the predetermined distance between the first position and the second position of the prior turn section;

at least another portion of the primary winding part positioned at the first position in the subsequent turn section and at least another portion of the secondary winding part positioned at the second position in the subsequent turn section are separated from each other by the predetermined distance between the first position and the second position of the subsequent turn section, and the at least one portion of the secondary winding part at the second position in the prior turn section is in contact with the at least another portion of the primary winding part at the first position in the adjacent subsequent turn section, the at least one portion of the secondary winding part at the second position in the prior turn section and the at least another portion of the primary winding part at the first position in the subsequent turn section being adjacent to each other on the same surface of the core portion.

2. A method for manufacturing a wire-wound coil including a core member including a core portion and collar portions formed at either end of the core portion, the core portion including a prior turn section and an adjacent subsequent turn section; the prior turn section has a first position and a second position, the first and second positions being at a predetermined distance apart from each other; the subsequent turn section has a first position and a second position, the first and second positions being at a predetermined distance apart from each other; the second position of the prior turn section being adjacent to the first position of the subsequent turn section; a pair of windings including a primary winding part and a secondary winding part wound around a surface of the core portion, and electrode portions formed on the collar portions, the ends of the primary winding part and the ends of the secondary winding part of the windings being connected to the electrode portions, the method comprising:

winding the pair of windings on the surface of the core portion such that at least one portion of the primary winding part is positioned at the first position in the prior turn section and at least one portion of the secondary winding part is positioned at the second position in the prior turn section so as to be separated from each other by the predetermined distance between the first position and the second position of the prior turn section; and further winding the pair of windings on the surface of the core portion such that at least another portion of the primary winding part is positioned at the first position in the subsequent turn section and at least another portion of the secondary winding part is positioned at the second position in the subsequent turn section so as to be separated from each other by the predetermined distance between the first position and the second position of the subsequent turn section, and such that the at least one portion of the secondary winding part at the second position in the prior turn section is in contact with the at least another portion of the primary winding part at the first position in the adjacent subsequent turn section, wherein the at least one portion of the secondary winding part at the second position in the prior turn section and the at least another portion of the primary winding part at the first position in the subsequent turn section being adjacent to each other on the same surface of the core portion.

3. The method for manufacturing the wire-wound coil according to claim 2, wherein the primary winding part and the secondary winding part include the prior turn section wound around the surface of the core portion first and then the subsequent turn section wound around the surface of the core portion subsequent to the prior turn section, and the at least another portion of the primary winding part in the subsequent turn section and the at least one portion of the secondary winding part in the prior turn section are in contact with each other such that a distance in a winding-axis direction between the center of the one portion of the secondary winding part in the prior turn section and the center of the at least another of the primary winding part in the subsequent turn section corresponds to the radius of the primary winding part or the radius of the secondary winding part.

* * * * *